United States Patent [19]

Bialy

[11] 4,244,312

[45] Jan. 13, 1981

[54] TAILOR TACKING ATTACHMENT

[75] Inventor: Edward Bialy, Hillside, N.J.

[73] Assignee: The Singer Company, Stamford, Conn.

[21] Appl. No.: 132,711

[22] Filed: Mar. 21, 1980

[51] Int. Cl.[3] ..... D05B 29/12; D05B 3/02

[52] U.S. Cl. ..... 112/235; 112/158 R; 112/179

[58] Field of Search ..... 112/235, 240, 158 R, 112/160, 179

[56] References Cited

U.S. PATENT DOCUMENTS

| | | | |
|---|---|---|---|
| 915,945 | 3/1909 | Eichorn | 112/179 |
| 1,075,695 | 10/1913 | Corey | 112/235 X |
| 2,063,845 | 12/1936 | Karle | 112/160 |

*Primary Examiner*—Peter P. Nerbun

*Attorney, Agent, or Firm*—William V. Ebs; Robert E. Smith; Edward L. Bell

[57] ABSTRACT

A tailor tacking device attachable to the presser bar of a zig-zag sewing machine is provided with an elongated member to support the loops of zig-zag stitches and move from an elevated to a depressed position during downward movement of a needle bar to avoid having the supporting member interfere at such time with the needle of the machine.

10 Claims, 5 Drawing Figures

TAILOR TACKING ATTACHMENT

BACKGROUND OF THE INVENTION

1. Field of the Invention

The invention relates to sewing machine attachments providing for the formation of loose loops of thread in zig-zag stitches.

2. Description of the Prior Art

It becomes desirable at times to be able to form loose loops of thread in zig-zag stiches on a sewing machine, as for example, when a pattern is to be tacked to layers of fabric with stitches which subsequently are to be cut and removed, or when a decorative fringe such as may be formed from severed loops of thread is needed to finish off the edges of a table scarf, linen placemat, napkin or the like. Sewing machine attachments which include a fixed support over which zig-zag stitches may be formed to provide loose loops of thread are well known. However, such attachments have suffered from a disadvantage in that the height of the fixed support and therefore the length of the loops which could be formed thereon was limited to an undesirable extent by the need to avoid interference of the support with the sewing needle of the machine as it descended during the formation of zig-zag stitches.

SUMMARY OF THE INVENTION

In accordance with the invention a loop forming sewing machine attachment is provided with an elongated member to support the loops of zig-zag stitches and move from an elevated to a depressed position during downward movement of a needle bar to avoid having the supporting member interfere with the needle of the machine. The device includes a shank adapted for attachment to a presser bar and a sole plate with a needle accommodating opening permitting the formation by a sewing needle of zig-zag stitches in fabric under the sole plate. The movable elongated member operably associates with the needle bar for movement therewith in a downward direction from its elevated position during downward movement of the needle bar, and return means cause the member to resume its elevated position as the needle bar rises.

DESCRIPTION OF THE PREFERRED EMBODIMENT

Figure 1:
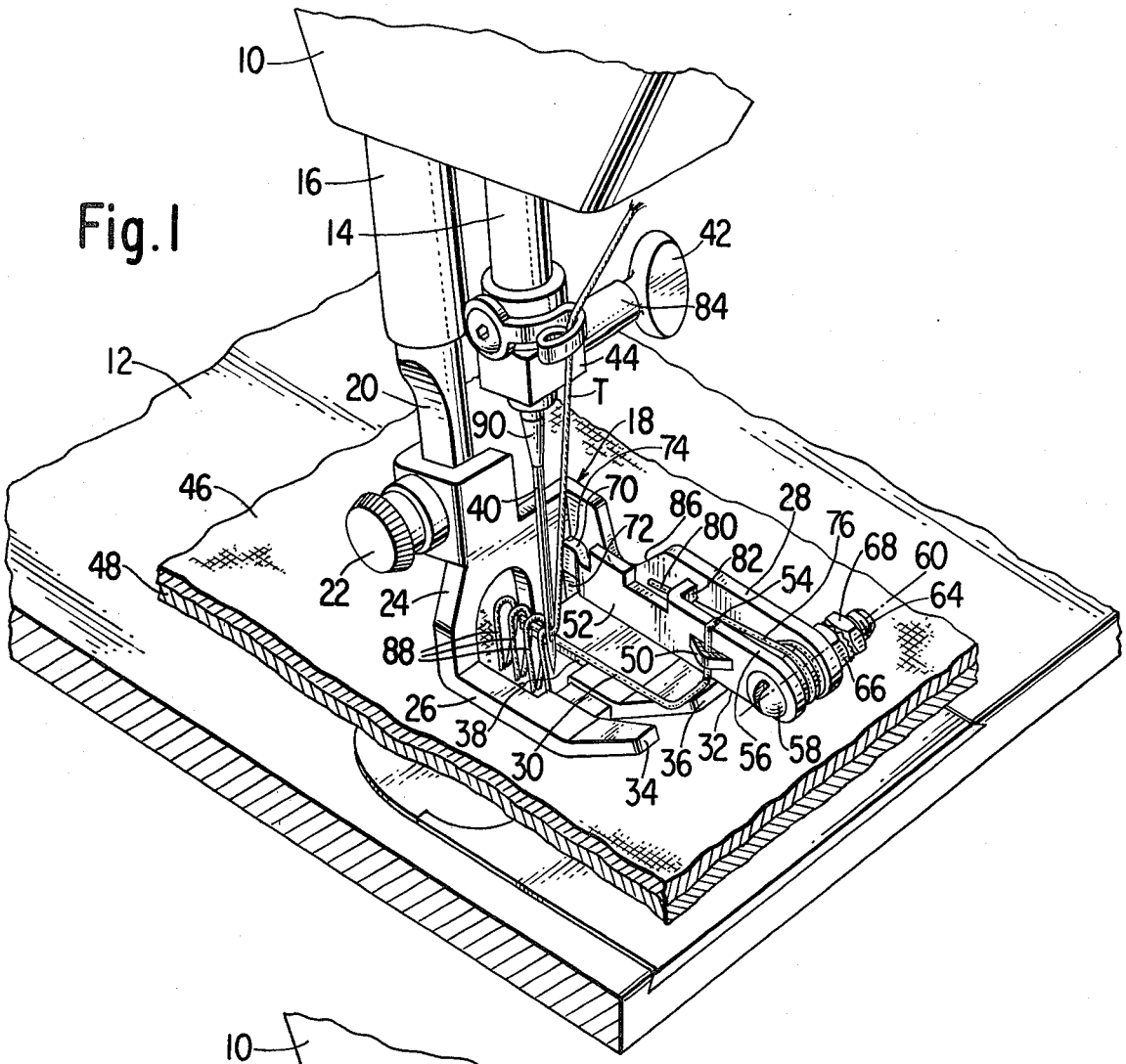
FIG. 1 is a perspective view showing the loop forming attachment of the invention in use on a sewing machine illustrated in the phase of its operating cycle wherein the sewing needle is descending on one side of the loop supporting member of the attachment.

Referring to the drawings, reference character 10, designates a head end portion of a lockstitch zig-zag sewing machine including a work supporting bed 12.

The head end portion 10 carries a reciprocable needle bar 14 and a presser bar 16. A loop forming attachment 18 according to the invention is shown affixed to a flattened lower end portion 20 of the presser bar 16 with a thumb screw 22.

Attachment 18 includes an upstanding shank 24, a sole plate 26, a side bracket 28, an elongated loop supporting member 30, and a pivoted member 32 to which the loop supporting member 30 is secured. The shank 24, sole plate 26 and side bracket 28 are preferably formed as a single piece of plastic material.

As shown, the sole plate 26 has upturned end toes 34 and 36, and a needle accommodating aperture 38 of sufficient width to permit a needle 40, secured with a thumb screw 42 in a needle clamp 44 on the needle bar 14, to sew layers 46 and 48 of material under the sole plate with zig-zag stitches. The needle accommodating aperture 38 extends through the shank 24 as indicated.

Elongated member 30 is a length of bent wire which is held is a fixed position relative to member 32 by a collar 50 formed on a side 52 of the member 32 and by an end projection 54 on the member 30 overlapping the top edge 56 of member 32. Member 30 extends for the greater portion of its length in a forward and rear direction on the machine, that is in the direction in which work is moved by a feed dog (not shown) under material to be sewn, and in alignment with a longitudinally extending center-line for needle aperture 38.

Member 32 is mounted with a screw 58 for pivotal movement on side bracket 28 about an axis 60. As shown the screw 58 extends through one end portion of the member 32 and an end portion of the bracket 28 remote from shank 24 as well as a cylindrical spacer 62 therebetween, and is secured at a threaded end portion 64 in a fixed position with nuts 66 and 68. A free end portion 70 of member 32 extends through a slot 72 in shank 24. The slot serves to guide movements of member 32 about pivotal axis 58 and to limit, by engagement of its upper end 74 with portion 70 of the member 32, upward movement of the member 32 as well as of member 30. A torsion spring 76 wrapped around spacer 62 and having opposite ends 78 and 80 which respectively engage sole plate 26 and a right angle tab 82 on member 32 biases member 32 upwardly about its pivotal axis to the position defined by the upper end 74 of slot 72. However, member 32 is movable downwardly against the biasing force of spring 76 by engagement of a shank 84 on needle clamp 44 with member 32 as the shank enters a trough 86 in side bracket 28 during downward strokes of the needle bar.

The needle bar 14, when in a raised position, jogs in the head end portion 10 of the machine from one to another of slightly angular alternate positions on opposite sides of a central position to provide for the formation of zig-zag stitches, and then descends in the assumed position to present thread T in the needle for seizure by a hook (not shown) in the bed of the machine, all as well understood for zig-zag lockstitch sewing machines.

Figure 2:
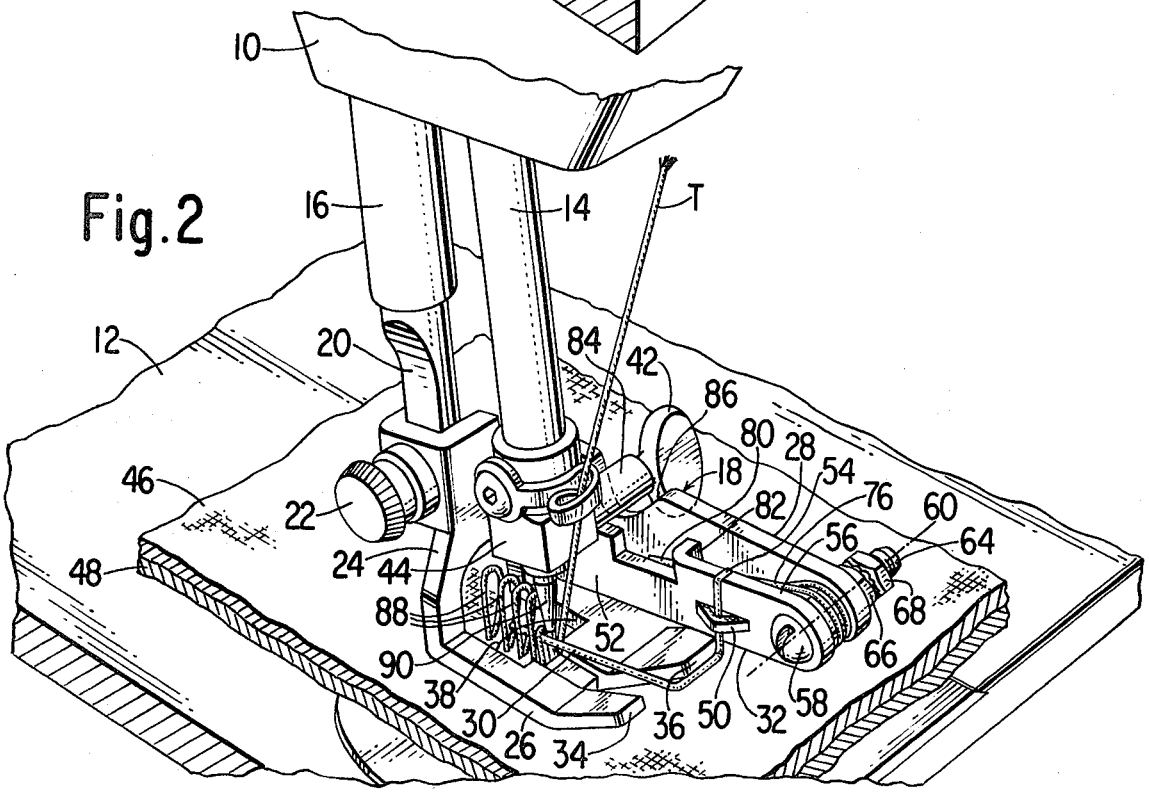
FIG. 2 is a view similar to FIG. 1, but with the machine at that phase of its operating cycle wherein the needle is at the bottom of its stroke on the other side of the loop supporting member.
Figure 3:
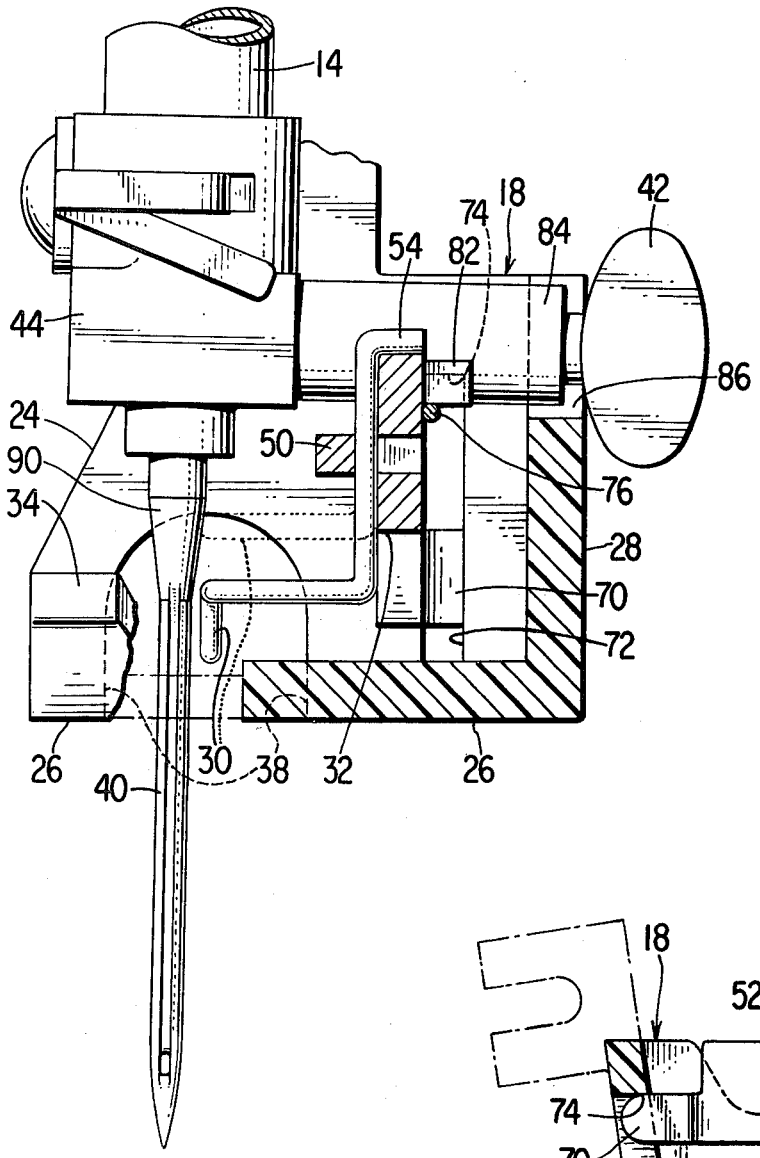
FIG. 3 is a front elevational view, showing the attachment partially in section and showing the sewing machine needle at the bottom of its stroke.
Figure 5:
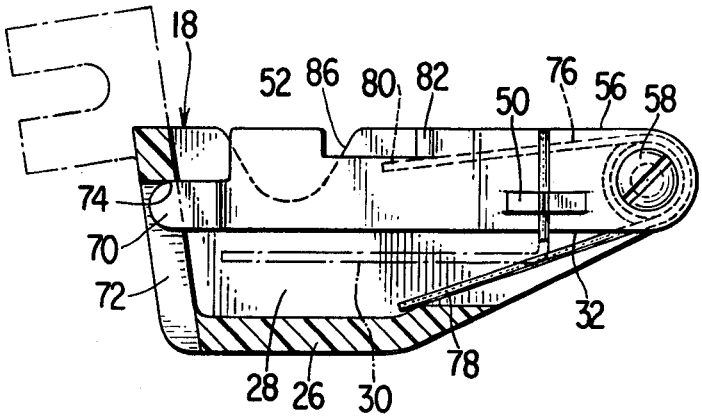
FIG. 5 is a longitudinal vertical sectional view of the attachment taken substantially on the plane of the line 5—5 of FIG. 4.
Figure 4:
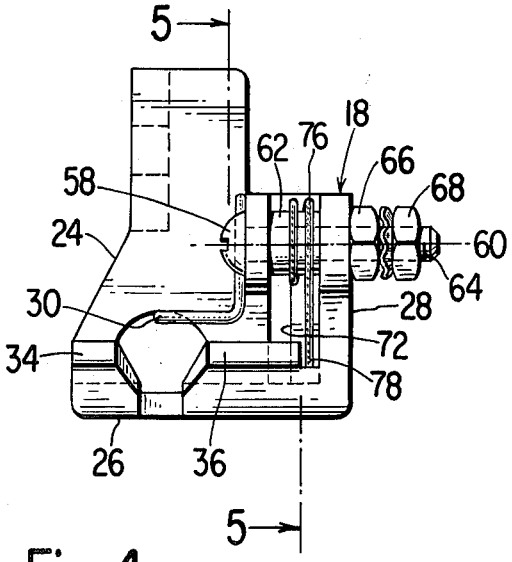
FIG. 4 is a front end view of the attachment.

With the attachment 18 in place zig-zag stitches are formed over elongated member 30 which is aligned with the central position of the needle bar. As the needle bar 14 descends, needle 40 is moved downwardly with thread T along a somewhat angular path extending to one side of member 30 (FIG. 1) and passes through materials being sewn to present the thread T for seizure by the hook in the bed. After seizure by the hook, the needle is moved upwardly and out of the materials, by the needle bar, the thread is drawn tight by the usual take-up (not shown) and the needle bar jogs to a new position. The needle bar and needle descend again and the needle moves with thread T along an angular path extending to the side of elongated member 30 opposite from which the needle had passed this member on the preceeding downward stroke to again present the thread to the hook of the machine for seizure (see FIG. 2). After seizure by the hook, the needle is moved upwardly as before, the thread is drawn tight and the needle bar is jogged across the central position.

During the latter portion of each downward movement of needle 40, member 32 is pressed downwardly by engagement of the shank 84 of needle clamp 44 with a top edge portion 86 of member 32, and member 30 with thread T held over its top edge by the needle is moved downwardly to a depressed position from an elevated position defined by the engagement of the free end portion 70 of member 30 with the upper end 74 of slot 72 in the shank 24 of attachment 18. Member 30 is returned by spring 76 to its elevated position during the initial portion of the upward stroke of the needle bar, and thread held over the member by the needle is then raised by the member to the elevated position. When the thread is drawn tight in a raised position of the needle above the work a loop 88 of a height defined by the elevated position of member 30 is completed.

A series of loops 88 may be formed in the manner described over member 30 in materials moved under the needle by a work feeding feed dog of conventional design. Loops 88 may be shed from member 30 continuously one by one as materials being sewn are advanced in small steps, or a series of loops formed with small advances of the materials may be shed all at once, as when tacking, by having the material fed a substantially greater distance than the small step advances between recurring series of the small advances.

Downward movement of member 30 during the latter portion of each downward movement of the needle 40 as already described keeps elongated member 30 out of the way of the upper diverging end 90 of the needle during its descent. Attachment 18 may therefor be constructed to provide for an elevated position of the member as high as may be required to assure the formation of long loops 88. This is in contrast to loop supporting attachments with fixed loop supporting members which if disposed high above the work would interfere with the needle causing damage to one or both engaging parts.

It should be understood that the present disclosure relates to only a preferred structural arrangement of the invention and should not be construed as a limitation thereof. Numerous alterations and modifications of the structure herein disclosed will suggest themselves to those skilled in the art, and all such modifications and alterations which do not depart from the spirit and scope of the invention are intended to be included within the scope of the appended claims.

I claim:

1. A tailor tacking device for use on a sewing machine including a presser bar, a reciprocable needle bar having a sewing needle secured thereto by a needle clamp, and means for feeding work under the needle, said tailor tacking attachment comprising a shank for attachment to the pressure bar, a sole plate with a needle accommodating opening permitting the formation by the sewing needle of the machine of zig-zag stitches in fabric under the sole plate, an elongated member which extends over said opening in the work feeding direction to provide a support for the loops of zig-zag stitches and which is operably associated with the needle bar for movement therewith from an elevated position into a depressed position during downward movement of the needle bar to avoid having the loop supporting member interfere, at such time, with the needle of the machine, and means for causing the elongated member to return to its elevated position during upward movement of the needle bar.

2. A tailor tacking device as defined in claim 1 wherein the return means for said elongated member is a spring.

3. A tailor tacking device as defined in claim 1 including a pivoted member to which the elongated member is attached for movement thereby during downward movement of the needle bar.

4. The combination of claim 3 wherein the return means is a torsion spring which acts against the pivoted member.

5. A tailor tacking device as defined in claim 3 wherein the pivoted member is disposed for actuation by the needle clamp.

6. A tailor tacking decive as defined in claim 1 including a side bracket, and a member to which said elongated member is attached mounted on the side bracket to define a pivotal axis for movement of the elongated member.

7. A tailor tacking device as defined in claim 1 including means limiting the elevated position in which the elongated member may be disposed by the return means.

8. A tailor tacking device as defined in claim 1 including a pivoted member to which the elongated member is attached for movement thereby during downward movement of the needle bar, and including means for guiding movement of the pivotal member.

9. A tailor tacking device as defined in claim 8 wherein the guiding means is a slot disposed in the shank to receive an end portion of the pivoted member.

10. A tailor tacking device as defined in claim 9 wherein the guiding means defines the elevated position in which the elongated member may be disposed by the return means.

* * * * *